US011840843B2

(12) United States Patent
Fortin

(10) Patent No.: US 11,840,843 B2
(45) Date of Patent: Dec. 12, 2023

(54) HAND RAILING APPARATUS AND SYSTEM

(71) Applicant: Firo Design Metal LLC, Powell, OH (US)

(72) Inventor: Daniel J. Fortin, Powell, OH (US)

(73) Assignee: Firo Design Metal LLC, Powell, OH (US)

( * ) Notice: Subject to any disclaimer, the term of this patent is extended or adjusted under 35 U.S.C. 154(b) by 167 days.

(21) Appl. No.: 17/519,945

(22) Filed: Nov. 5, 2021

(65) Prior Publication Data

US 2022/0145638 A1 May 12, 2022

Related U.S. Application Data

(60) Provisional application No. 63/111,829, filed on Nov. 10, 2020.

(51) Int. Cl.
*E04F 11/18* (2006.01)

(52) U.S. Cl.
CPC ... *E04F 11/1817* (2013.01); *E04F 2011/1821* (2013.01)

(58) Field of Classification Search
CPC ..... E04F 11/18; E04F 11/181; E04F 11/1812; E04F 11/1817; E04F 11/1863; E04F 2011/1819; E04F 2011/1821
See application file for complete search history.

(56) References Cited

U.S. PATENT DOCUMENTS

| | | | | |
|---|---|---|---|---|
| 4,664,227 | A * | 5/1987 | Hansen | E04F 11/18 256/65.16 |
| 6,336,620 | B1 * | 1/2002 | Belli | E04F 11/1812 248/519 |
| 7,121,382 | B2 * | 10/2006 | Jackson | E06C 7/46 182/201 |
| 7,913,983 | B1 * | 3/2011 | Sandor, Sr. | E04F 11/1812 256/60 |
| 8,240,710 | B1 * | 8/2012 | Rawls | B60R 3/005 182/113 |
| 8,814,145 | B2 * | 8/2014 | Herman | G01B 3/14 256/48 |
| 8,955,250 | B2 * | 2/2015 | Johnson | E04F 11/1812 47/32.4 |
| 9,470,013 | B2 * | 10/2016 | Munyon | E04F 11/1865 |
| 10,113,316 | B2 * | 10/2018 | Leary | E04F 11/1859 |
| 10,407,916 | B1 * | 9/2019 | Samad | E04F 11/1817 |

FOREIGN PATENT DOCUMENTS

| | | | |
|---|---|---|---|
| DE | 9316885 U1 * | 3/1994 | |
| KR | 20080078117 A * | 8/2008 | |

* cited by examiner

*Primary Examiner* — Jonathan P Masinick
(74) *Attorney, Agent, or Firm* — McDonnell Boehnen Hulbert & Berghoff LLP

(57) ABSTRACT

An adaptable step railing assembly including a rigid one-piece handrail unit, a pair of upright posts, and a pair of fasteners. The one-piece handrail unit including a pair of seamless post sockets and an upper elongated portion, the upper elongated portion extending between each seamless post socket. The pair of seamless post sockets are parallel to each other. Each seamless post socket is permanently attached to the upper elongated portion. An upright post is inserted inside each seamless post socket creating a deep socket connection. The insertion depth of the upright post is adapted to the corresponding set of steps pitch.

10 Claims, 8 Drawing Sheets

HAND RAILING APPARATUS AND SYSTEM

This non-provisional application claims priority to U.S. Provisional Patent Application No. 63/111,829, filed on Nov. 10, 2020, herein incorporated in its entirety.

The main purpose of a hand railing assembly is to provide safe mobility for an individual who is about to navigate up or down a set of stairway steps. For an installed hand railing to be safe and reliable, said railing must first be assembled in a secure and rigid fashion. When a hand railing assembly has unstable connections or loose fittings, said assembly presents a serious safety hazard for the user.

People rely on hand railings to be strong and secure when navigating stairway steps. Even the slightest wobble or unexpected movement of the hand railing can become a hazard. When a person grabs hold to use a hand railing that is not tight and secure, it may cause the user to lose their balance presenting a potential serious fall hazard for that person.

Commonly used custom fabricated step railings comprise of "design and build" systems. However, these custom-made "design and build" step railings will typically require a skilled professional to measure, fabricate, and/or install the railing correctly. Furthermore, custom hand railing fabricators are not readily available in many locations. Additionally, custom step railings can be very costly and time-consuming to build.

Adjustable step railings are an alternative to custom-made step railings. Adjustable step railings are typically assembled on-site using a variety or assortment of mechanical connectors to ensure proper fit to the stairway. For example, bracket fittings, nuts and bolts, and pivot pins are used to assemble and adjust railings to selected stairways. When in use, said fastening devices and connectors become important components of any step railing design. More significantly, connectors and fastening devices used to complete the assembly are critical to the integrity and safety of the step railing.

Many of these mechanical connectors and fastening devices can fail or become unstable and weaken after a period of time or with constant use making the step railing hazardous. Navigating a set of steps requires a person to balance themselves on one foot while they lift the other foot towards the next step on the stairs. Failure to provide a user with a rigid step rail assembly will greatly diminish the integrity and safety value of the handrail assembly. Loose connections or fittings within the step railing assembly will present a fall hazard for those who rely on step railings for safe passage as they move up or down a set of steps. Therefore, there is a need for a step railing assembly that can easily adapt to the pitch of a select stairway without custom modifications, while also incorporating a rigid, long-lasting and reliable connection with its components.

Currently disclosed is an adaptable step railing assembly comprising a rigid, one-piece upper handrail unit, wherein said assembly can be easily and firmly adapt to a wide variety of stair-step layouts without the use of any problematic connection devices.

Currently disclosed is an adaptable step railing assembly comprising: a one-piece handrail unit, a pair of upright posts, and a pair of fasteners. The adaptable step railing assembly may further comprise a second pair of fasteners. The one-piece handrail unit comprises an upper elongated portion and a pair of seamless post sockets, the upper elongated portion extending between each seamless post socket. The one-piece handrail unit may further comprise a lower elongated portion extending between each seamless post socket.

Each seamless post socket comprises a proximal end, a distal end, an internal cavity, and an opening. Each seamless post socket may further comprise a second opening. The proximal end is permanently attached to the upper elongated portion. If present, the distal end of each seamless post socket is permanently attached to the lower elongated portion. Each upright post comprises a proximal end, a distal end, an internal cavity and a plurality of threaded openings. The internal cavity of each seamless post socket is adapted to receive the proximal end of an upright post.

An upright post is inserted inside the internal cavity of a seamless post socket. The tolerance between the upright post and the seamless post socket may be no more than 0.04 inches (1.00 mm). The tolerance between the upright post and the seamless post socket may be no less than 0.010 inches (0.250 mm). Each fastener of the pair of fasteners is adapted to connect an upright post with a seamless post socket.

Also disclosed is a method for the installation of an adaptable step railing assembly. Said method comprising the steps of: placing an adaptable step railing assembly on a set of steps, wherein the adaptable step railing assembly comprises a one-piece handrail unit, a pair of upright posts, and a pair of fasteners. The adaptable step railing assembly may further comprise a second pair of fasteners. The one-piece handrail unit comprises an upper elongated portion and a pair of seamless post sockets, the upper elongated portion extending between each seamless post socket. The one-piece handrail unit may further comprise a lower elongated portion extending between each seamless post socket.

Each seamless post socket comprises a proximal end, a distal end, an internal cavity, and an opening. Each seamless post socket may further comprise a second opening. The proximal end of each seamless post socket is permanently attached to the upper elongated portion. If present, the distal end of each seamless post socket is permanently attached to the lower elongated portion.

Each upright post comprises a proximal end, a distal end, an internal cavity and a plurality of threaded openings. The internal cavity of each seamless post socket is adapted to receive the proximal end of an upright post. The tolerance between the upright post and the seamless post socket may be no more than 0.04 inches (1.00 mm). The tolerance between the upright post and the seamless post socket may be no less than 0.010 inches (0.250 mm). Each fastener of the pair of fasteners is adapted to connect an upright post with a seamless post socket.

The proximal end of an upright post of the pair of upright posts is inserted inside the internal cavity of each seamless post socket. The insertion depth of the upright post is matched to the set of steps pitch while aligning a threaded opening of the plurality of threaded openings of the upright post to the opening of the corresponding seamless post socket. Then, a fastener of the pair of fasteners is inserted through the aligned opening of the seamless post socket and the aligned threaded opening of the plurality of threaded openings connecting the corresponding seamless post socket and upright post. The second post socket of the pair of seamless post sockets and the second upright post of the pair of upright posts are connected in a similar fashion. Finally, each upright posts is affixed to the set of steps.

Each upright post may further comprise a base plate. Said base plate comprising an aperture a series of mounting holes. Thus, the disclosed method may further comprise the steps of: inserting the distal end of the upright post inside the base plate aperture and affixing the base plate to the upright post and inserting a bolt in each of the mounting holes of the base plate. Then, affixing each bolt to the set of steps.

Moreover, the disclosed method may further comprise the steps of: aligning a second threaded opening of the plurality of threaded openings of the upright post to a second opening of the corresponding seamless post socket. Then, inserting a fastener of the second pair of fasteners through the aligned second opening of the seamless post socket and the aligned second threaded opening of the plurality of threaded openings of the upright post. Finally, connecting the corresponding seamless post socket and upright post.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION OF THE DRAWINGS

Figure 2:
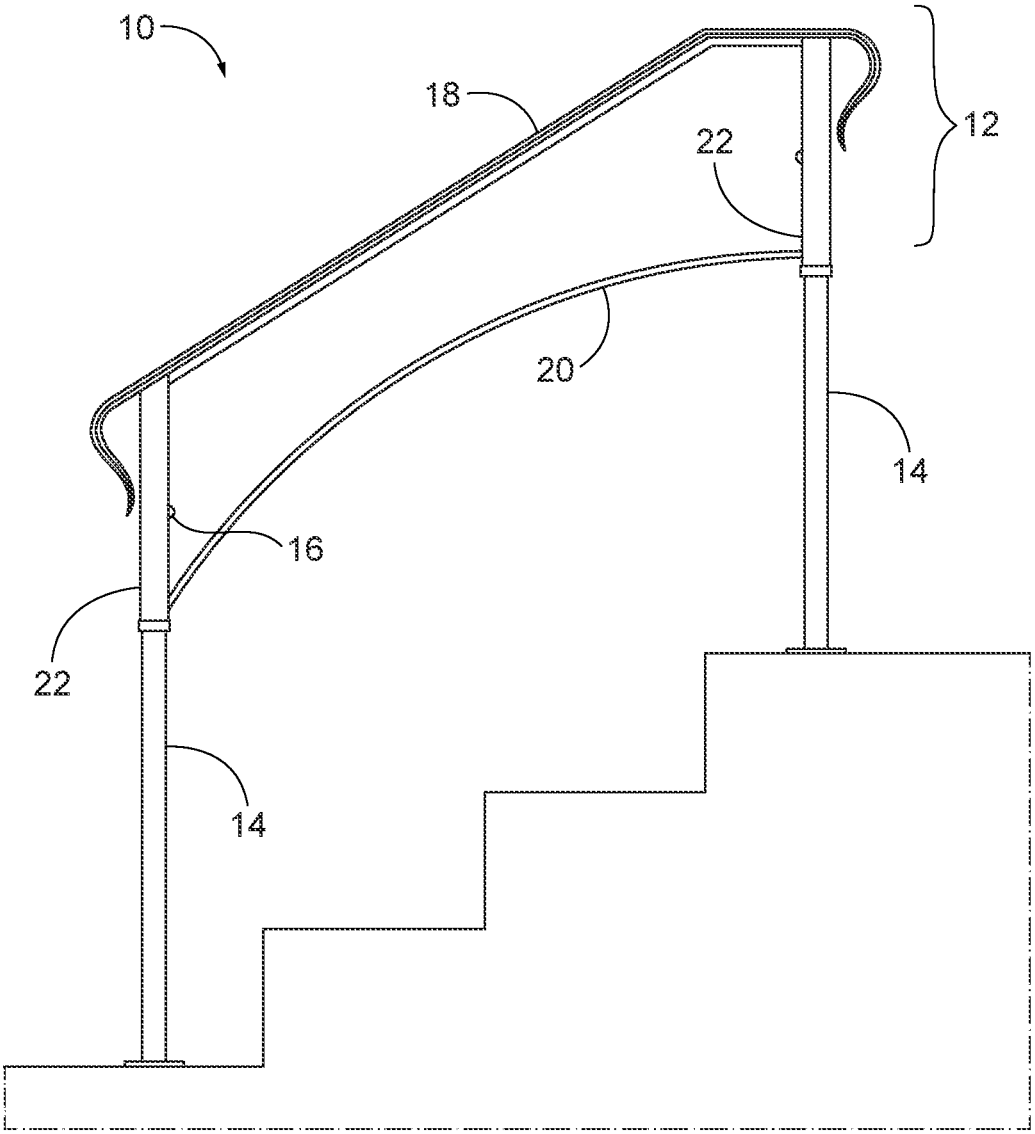
FIG. 2 illustrates an adaptable step railing assembly.
Figure 3:
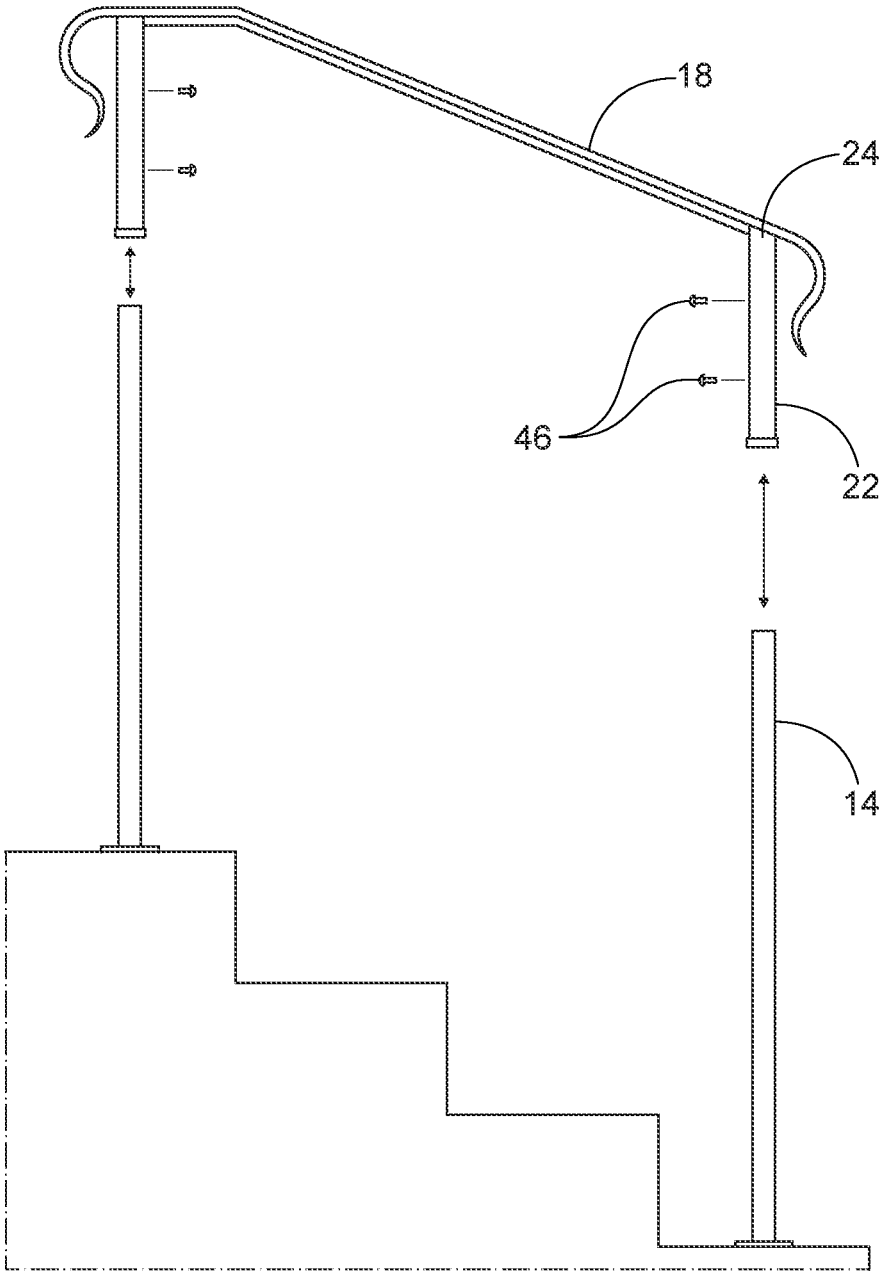
FIG. 3 illustrates an adaptable step railing assembly.
Figure 4:
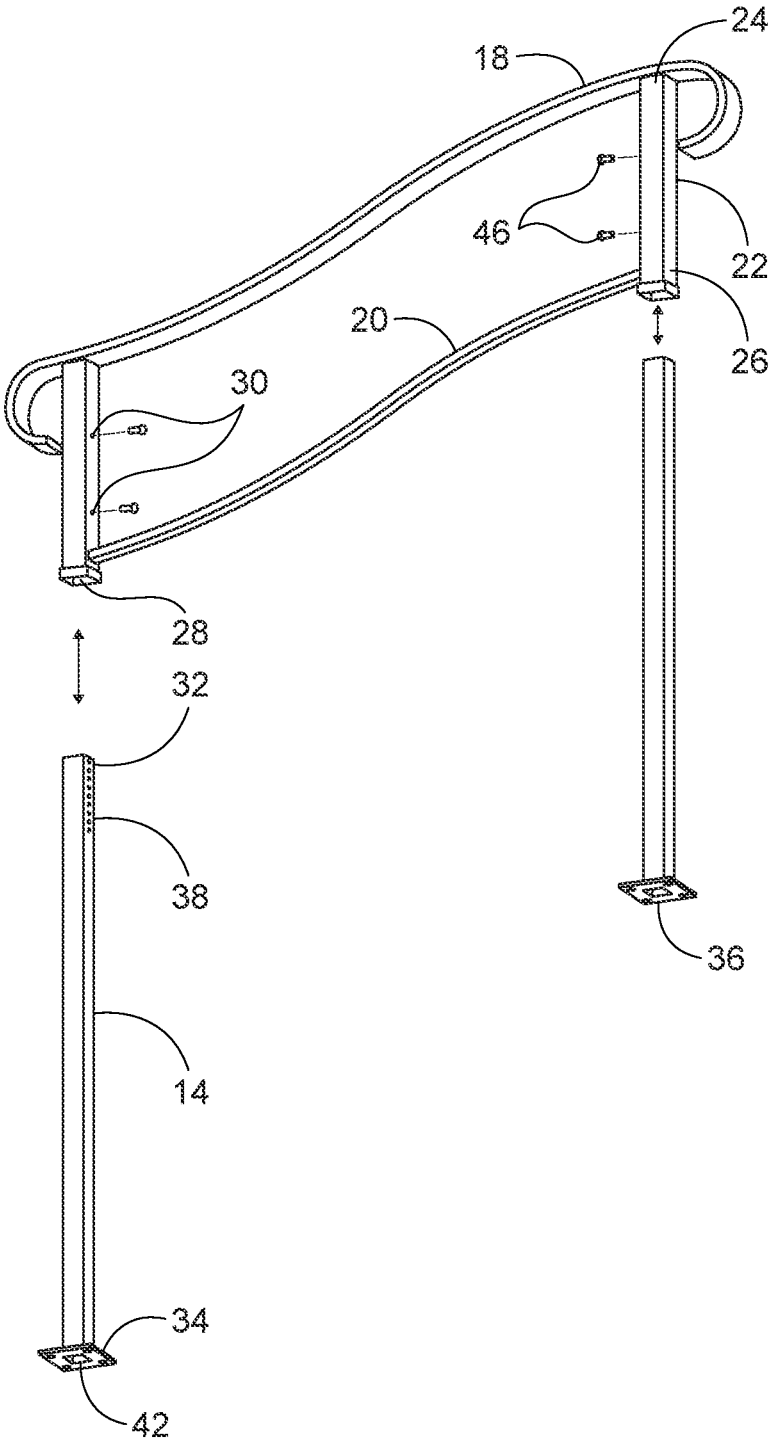
FIG. 4 illustrates an adaptable step railing assembly.

Currently disclosed is an adaptable step railing assembly with a limited amount of fastening connectors providing for an adjustable, safe, stable and longer lasting handrail system. As shown in FIGS. 1-8B, adaptable step railing assembly 10 comprises a one-piece handrail unit 12, a pair of upright posts 14, and a pair of fasteners 16. As shown in FIG. 3 and FIG. 4, the step railing assembly may further comprise a second pair of fasteners 46.

Figure 1:
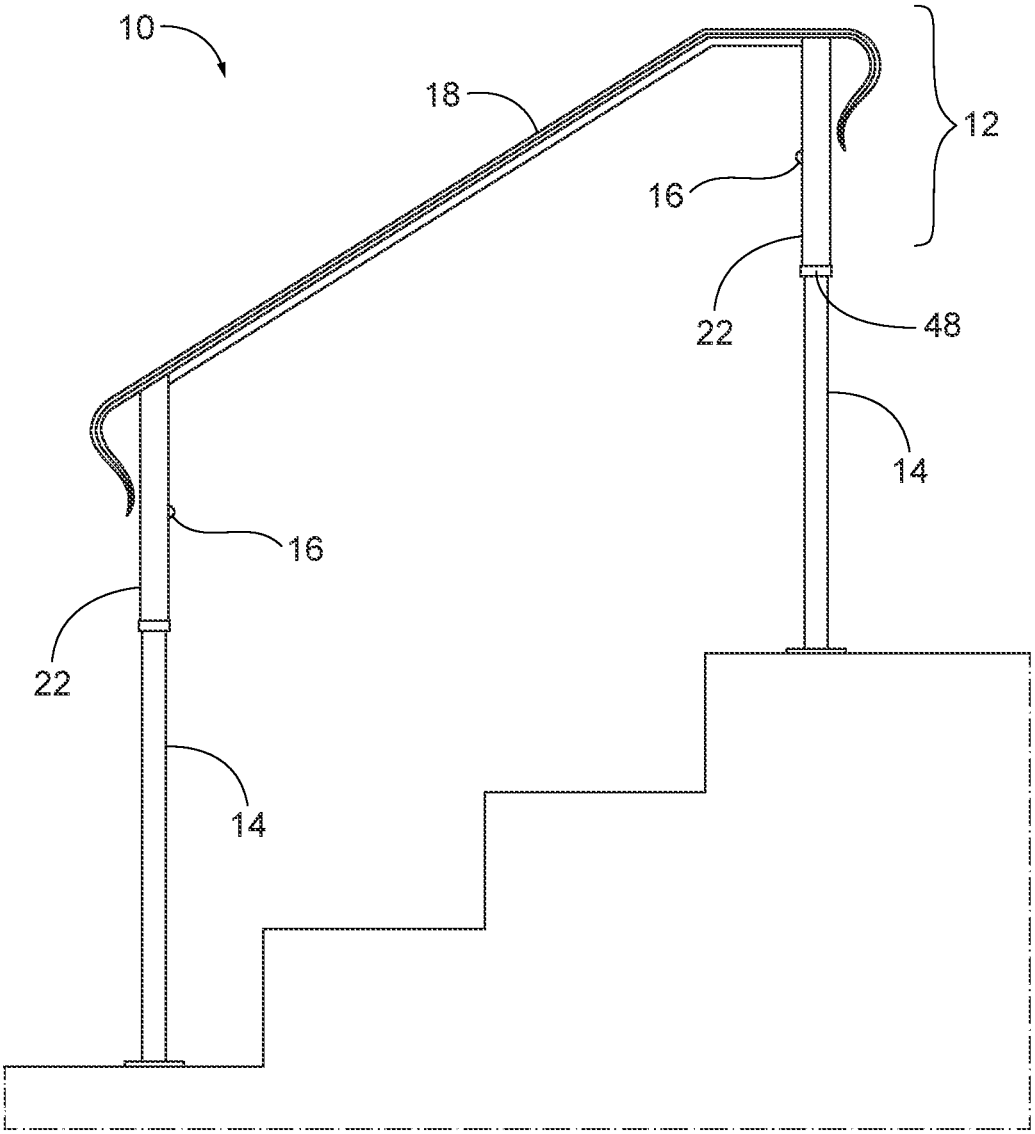
FIG. 1 illustrates an adaptable step railing assembly.

As illustrated in FIG. 1, the one-piece handrail unit 12 comprises an upper elongated portion 18 and a pair of seamless post sockets 22. The upper elongated portion 18 extends between each seamless post socket 22. Alternatively, or additionally, as illustrated in FIG. 2, the one-piece handrail unit 12 may further comprise a lower elongated portion 20 extending between each seamless post socket 22.

As identified in FIG. 4, each seamless post socket 22 comprises a proximal end 24, a distal end 26, and an internal cavity 28. The proximal end 24 of each seamless post socket is permanently attached to the upper elongated portion 18 providing for a rigid one-piece handrail unit. Similarly, the distal end 26 of each seamless post socket is permanently attached to the lower elongated portion 20 providing for a rigid one-piece handrail unit. When a person is navigating up or down a set of stair steps, the rigidity of the one-piece handrail unit is essential for safe reliability of the step railing assembly as the handrail is the portion said person grabs onto for assistance.

Figure 5:
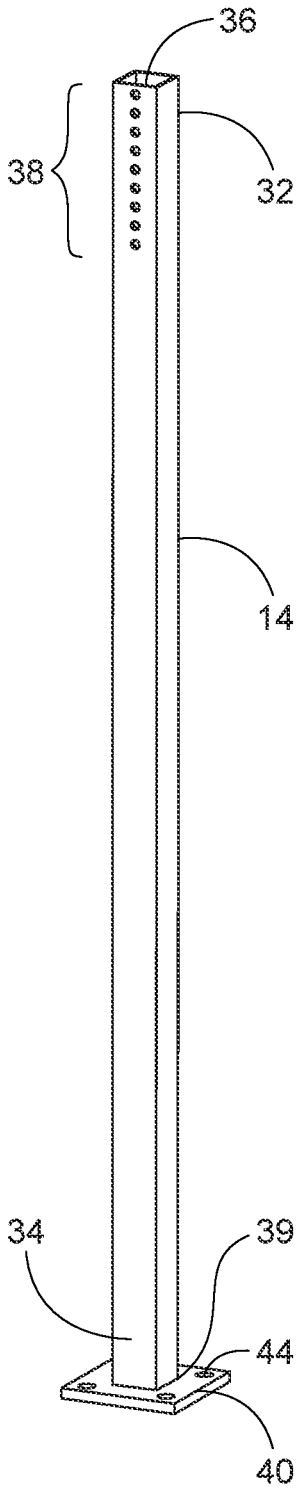
FIG. 5 illustrates an upright post.
Figure 6:
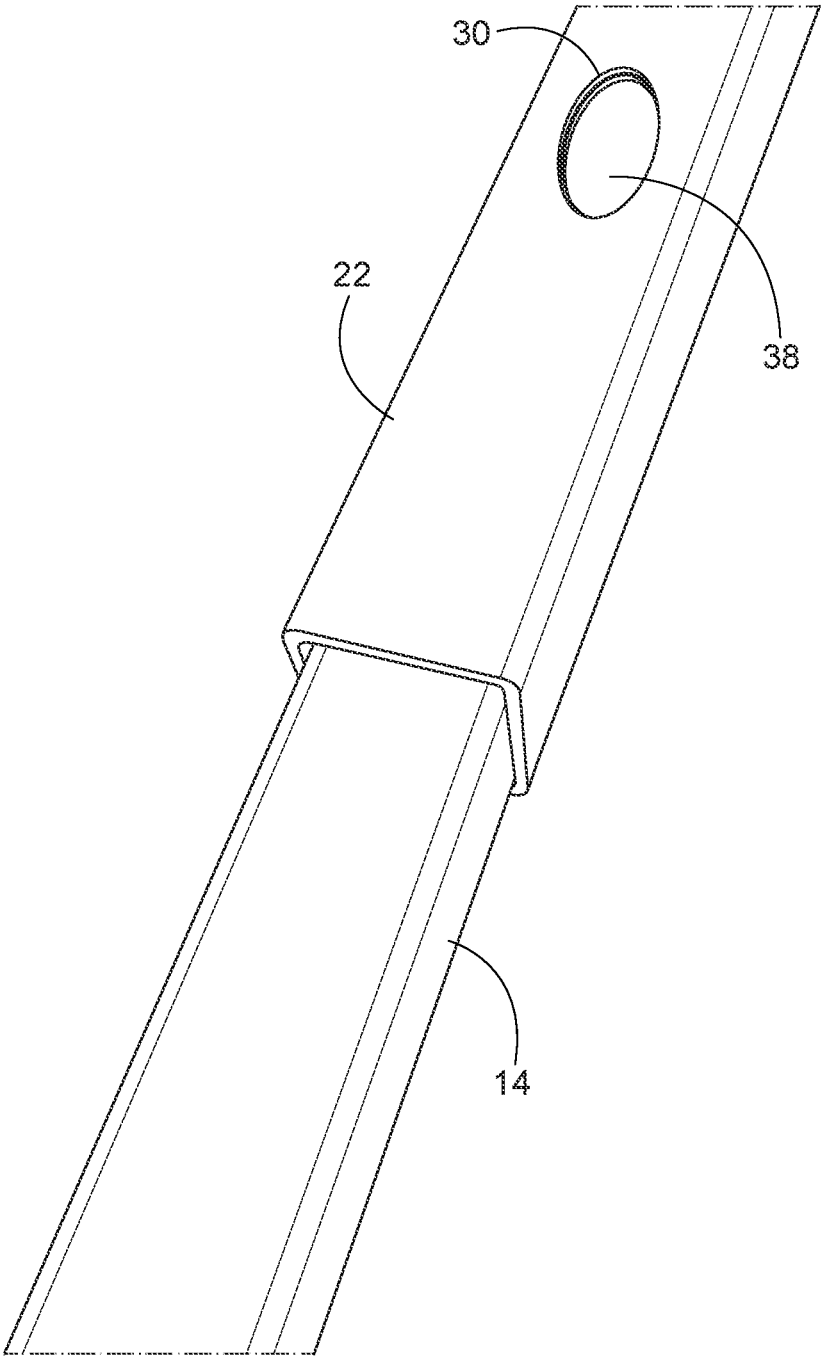
FIG. 6 illustrates a close-up view of an upright post and seamless post socket.

Each seamless post socket 22 further comprises an opening 30, said opening adapted to received one fastener of the pair of fasteners. Each seamless post socket may further comprise a second opening 30. Each seamless post socket 22 is adapted to receive a single upright post 14. As illustrated in FIGS. 4-5, each upright post 14 comprises a proximal end 32, a distal end 34, an internal cavity 36, and a plurality of threaded openings 38. As shown in FIGS. 3-4 and FIG. 6, the upright post proximal end 32 slides into the internal cavity 28 of the seamless post socket 22 providing for a deep socket connection between the post socket and the upright post. A cover 38 may be placed at the distal end of the seamless post socket 22 where the post socket meets the upright post 14.

The deep socket connection between the seamless post socket and the upright post provides a sturdy connection between the one-piece handrail unit 12 and the pair of upright posts 14. Said deep socket connection together with the rigidity of the one-piece handrail unit provide for the minimal use of fastening systems in the currently claimed adaptable step railing assembly. As claimed, the disclosed step railing assembly comprises a single pair of fasteners eliminating stability problems associated with common step railings, which use a variety of attachments or unreliable bolted connections for final assembly. The disclosed and claimed adaptable step railing assembly may comprise a second pair of fasteners. However, said second pair of fasteners is not necessary. The currently disclosed and claimed adaptable step railing assembly provides a stable handrail system with the use of a single pair of fasteners.

Figure 7:
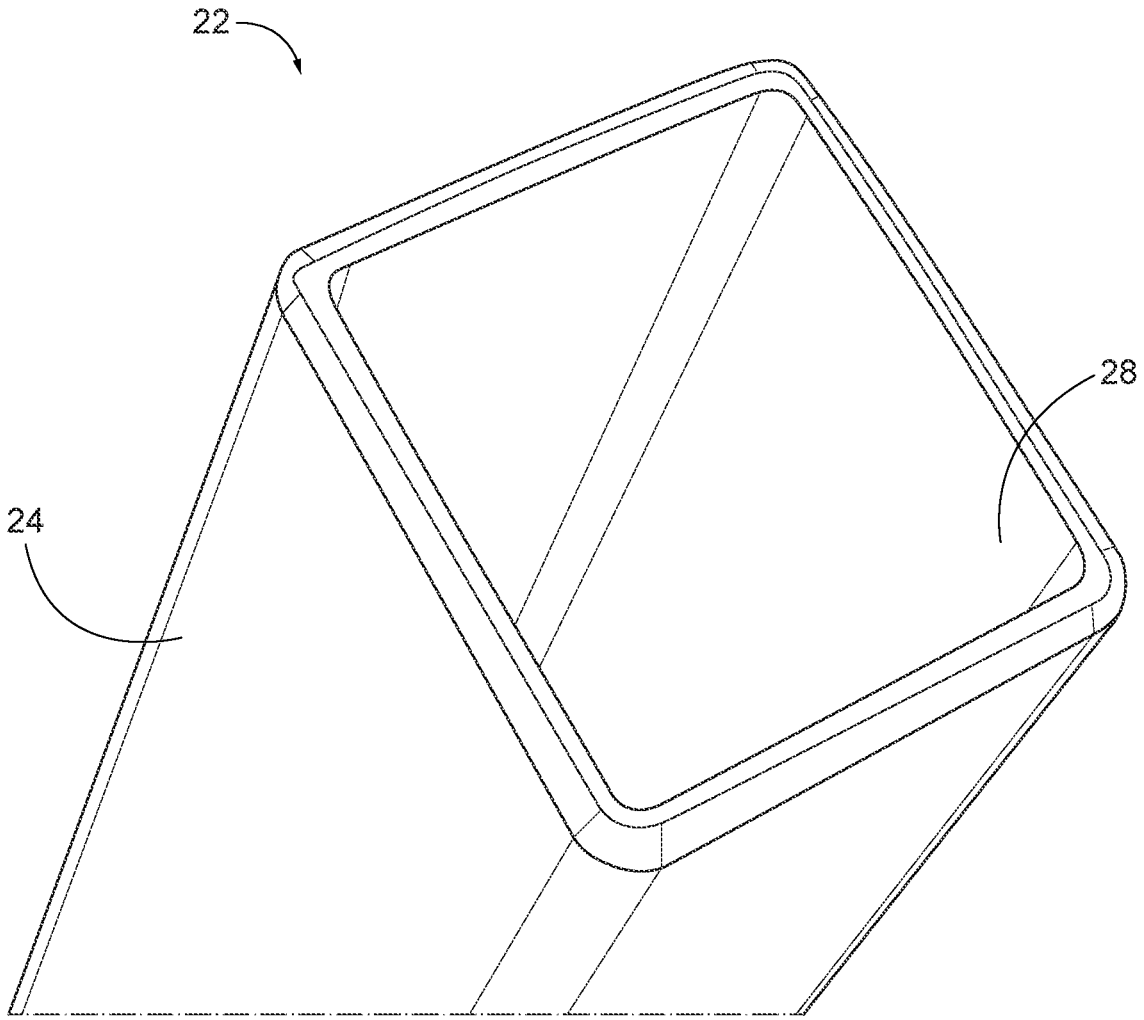
FIG. 7 illustrates a top view of a seamless post socket.

As illustrated in FIG. 7, each post socket 22 is seamless. The post socket seamlessness facilitates a tight fit and tolerance between the post socket and the upright post. The tolerance between a seamless post socket and an upright post may be between a range of 0.010 inches (0.250 mm) and 0.04 inches (1.00 mm). The tolerance between a seamless post socket and an upright post is no more than 0.04 inches (1.00 mm) and no less than 0.10 inches (0.250 mm).

The seamless post sockets 22 contained within the one-piece handrail unit 12 allow for a simpler more reliable connection with each of the vertical upright posts 14. Each upright post 14 may fit into a seamless post socket 22 and slide in and out of the post socket to simplify assembly and effectively improve the assembly connection process and most importantly provide a tight fitted rigid connection for long-term reliability.

Figure 8B:
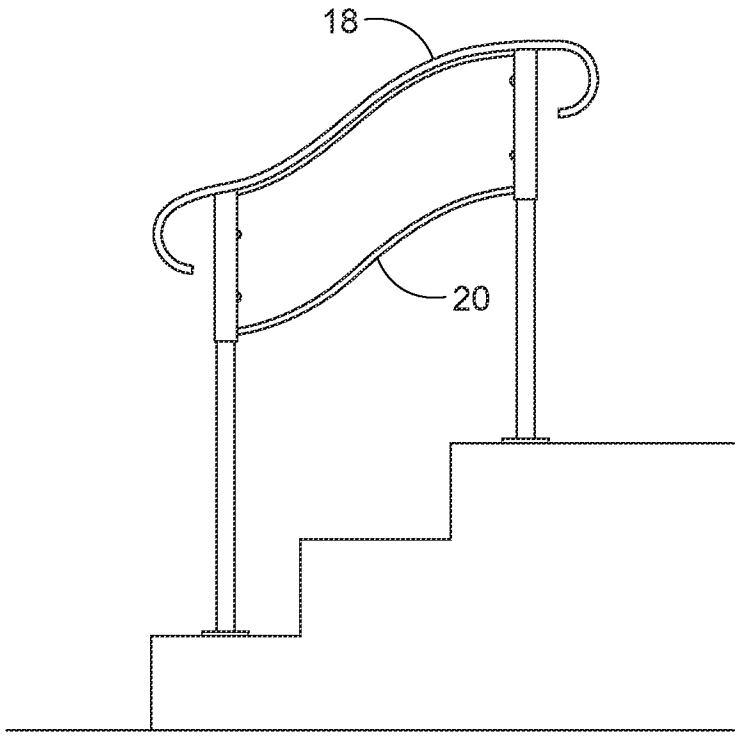
FIG. 8B illustrates an adaptable step railing assembly.
Figure 8A:
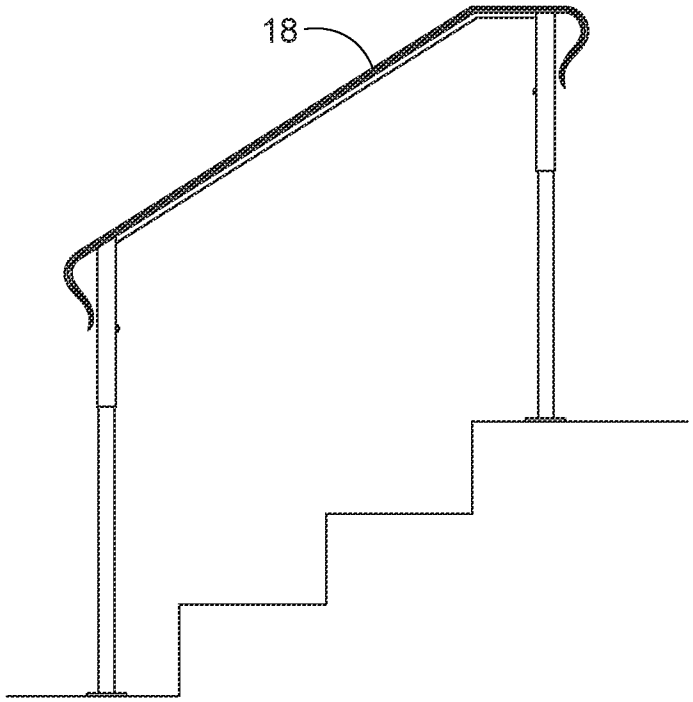
FIG. 8A illustrate an adaptable step railing assembly.

As illustrated in FIGS. 8A and 8B, the currently disclosed invention may easily adapt to a variety of stair-step layouts. The one-piece handrail unit of the step rail assembly utilizes the tight tolerances between each seamless post socket 22 and the corresponding upright post 14 to secure the vertical upright post 14 with the rigid one-piece handrail unit 12. As shown, for example in FIGS. 3-4, the telescoping nature of the connection between the one-piece handrail unit and the upright posts offers easy adjustment and adaptability of the step railing assembly to a select set of steps.

An upright post 14 is inserted inside the internal cavity 28 of each of the seamless post sockets 22 of the one-piece handrail unit 12 creating a deep socket connection. The insertion depth of the upright post may be at least 2 inches deep, preferably 3 inches deep. Once each upright post is adjusted and in proper position to match the specific stairway pitch, as illustrated in FIG. 6, one of the plurality of threaded openings 38 of the upright post 14 is aligned with the opening 30 of the corresponding seamless post socket 22. Then, a fastener of the pair of fasteners 16 is inserted in each seamless post socket through the aligned opening 30 of the seamless post socket 22 and the aligned threaded opening of the plurality of threaded openings 38 of the upright post 14. Each fastener engages a seamless post socket with an upright post effectively locking the one-piece handrail unit and the upright posts into their final adjusted position before anchoring the step railing assembly to the steps.

Each seamless post socket may comprise a second opening 30. A second threaded opening of the plurality of threaded openings of each upright post may be aligned with the second opening of the seamless post socket. A second fastener of the second pair of fasteners 46 may be inserted in each seamless post socket through the aligned second opening 30 of each seamless post socket 22 and the aligned second threaded opening of the plurality of threaded opening 38 of the upright post. Each fastener engages a seamless post socket with an upright post effectively locking the one-piece handrail unit and the upright posts into their final adjusted position before anchoring the step railing assembly to the steps.

As illustrated in FIGS. 4-5, each upright post 14 may further comprise a base plate 40. The base plate 40 comprises an aperture 42 and a series of mounting holes 44. The distal end of the upright post is inserted inside the aperture of the base plate and securely affixed to the base plate. The mounting holes 44 of the base plate allows for the step railing assembly to be anchored onto the steps and into its final installed position. Selected anchoring bolts suitable to the specific steps surface or substrate are used to installed the step railing assembly to the steps.

Further, the adaptable step railing assembly may be used for various stair tread sizes. As shown in FIGS. 8A and 8B, the length of the upper elongated portion 18 and the length of the lower elongated portion 20 between the pair of seamless post sockets 22, forming the one-piece handrail unit, may vary to meet the length distance associated with different step tread sizes. Regardless of the length, an upright post is connected to the one-piece handrail unit through each seamless post socket. The height of each end of the one-piece handrail unit is adjusted by aligning a threaded opening of the plurality of threaded openings of each upright post with the opening of each seamless post socket to match the pitch of the selected steps. The corresponding upright post and seamless post socket are engaged together by a fastener of pair of fasteners; thus, providing the currently claimed and disclosed adaptable step railing assembly.

The currently disclosed adaptable step railing assembly may comprise a rigid metal material or composite material adapted to manage applied loads that meet or exceed associated step rail code requirements. Said rigid metal material or composite material may include steel, aluminum, stainless steel and/or a strong composite material suitable for exterior use.

While this invention has been shown and described with respect to a detailed embodiment thereof, it will be understood by those skilled in the art that changes in form and detail thereof may be made without departing from the scope of the claims of the invention.

What is claimed:

1. An adaptable step railing assembly comprising:

a one-piece handrail unit;

a pair of upright posts; and a pair of fasteners, wherein the one-piece handrail unit comprises an upper elongated portion, a lower elongated portion, and a pair of seamless post sockets, wherein the upper elongated portion and the lower elongated portion extend between each seamless post socket, wherein each seamless post socket comprises a proximal end, a distal end, an internal cavity, and an opening, the proximal end permanently attached to the upper elongated portion, the distal end permanently attached to the lower elongated portion, and the opening located between the upper elongated portion and the lower elongated portion, wherein each upright post comprises a proximal end, a distal end, an internal cavity, and a plurality of threaded openings, wherein the internal cavity of each seamless post socket is adapted to receive the proximal end of an upright post, wherein tolerance between the upright post and the seamless post socket is no more than 0.04 inches (1.00 mm), and wherein each fastener of the pair of fasteners is adapted to connect an upright post with a seamless post socket by partially extending into the opening of the seamless post socket and a threaded opening of the upright post between the upper elongated portion and the lower elongated portion.

2. The adaptable step railing assembly as claimed in claim 1, wherein each upright post further comprises a base plate, the base plate including an aperture and a series of mounting holes.

3. The adaptable step railing assembly as claimed in claim 1, wherein the tolerance between an upright post and a seamless post socket is no less than 0.010 inches (0.250 mm).

4. The adaptable step railing assembly as claimed in claim 1, wherein the seamless post socket further comprises a second opening.

5. The adaptable step railing assembly as claimed in claim 4, further comprising:

a second pair of fasteners, wherein each fastener of the second pair of fasteners is adapted to further connect the upright post with the seamless post socket.

6. A method for installation of an adaptable step railing assembly comprising the steps of:

placing an adaptable step railing assembly on a set of steps, wherein the adaptable step railing assembly comprises:

a one-piece handrail unit;

a pair of upright posts; and a pair of fasteners, wherein the one-piece handrail unit comprises an upper elongated portion, a lower elongated portion, and a pair of seamless post sockets, wherein the upper elongated portion and the lower elongated portion extending between each seamless post socket, wherein each seamless post socket comprises a proximal end, a distal end, an internal cavity, and an opening, the proximal end permanently attached to the upper elongated portion, the distal end permanently attached to the lower elongated portion, and the opening located between the upper elongated portion and the lower elongated portion, wherein each upright post comprises a proximal end, a distal end, an internal cavity, and a plurality of threaded openings, wherein the internal cavity of each seamless post socket is adapted to receive the proximal end of an upright post, wherein tolerance between the upright post and the seamless post socket is no more than 0.04 inches (1.00 mm), and wherein each fastener of the pair of fasteners is adapted to connect an upright post with a seamless post socket by partially extending into the opening of the seamless post socket and a threaded opening of the upright post between the upper elongated portion and the lower elongated portion;

inserting a proximal end of an upright post of the pair of upright posts inside the internal cavity of each seamless post socket;

adjusting insertion depth of the upright post to match the sets of steps pitch;

aligning one of the plurality of threaded openings of the upright post to the opening of the corresponding seamless post socket;

inserting a fastener of the pair of fasteners through the aligned opening of the seamless post socket and into the aligned threaded opening of the plurality of threaded openings;

connecting the corresponding seamless post socket and upright post; and affixing the upright posts to the set of steps.

7. The method for installation of an adaptable step railing as claimed in claim 6, wherein each upright post further comprises a base plate, the base plate including an aperture and a series of mounting holes.

8. The method for installation of an adaptable step railing assembly as claimed in claim 7, further comprising the steps of:

inserting the distal end of the upright post inside the base plate aperture, affixing the base plate to the upright post;

inserting a bolt in each of the mounting holes of the base plate;

affixing the bolt to the set of steps.

9. The method for installation of an adaptable step railing assembly as claimed in claim 6, wherein the adaptable step railing assembly further comprises a second pair of fasteners, and each seamless post socket comprises a second opening.

10. The method for installation of an adaptable step railing assembly as claimed in claim 9 further comprising the steps of:

aligning a second threaded opening of the plurality of threaded openings of the upright post to the second opening of the corresponding seamless post socket;

inserting a fastener of the second pair of fasteners through the aligned second opening of the seamless post socket and into the second threaded opening of the plurality of threaded openings of the upright post; and connecting the corresponding seamless post socket and upright post.

* * * * *